US008813263B2

(12) United States Patent
Parisi, Jr. et al.

(10) Patent No.: US 8,813,263 B2
(45) Date of Patent: Aug. 26, 2014

(54) QUICK RELEASE CONNECTION ASSEMBLY

(75) Inventors: Brian Matthew Parisi, Jr., Evanston, IL (US); Martin J. Nilsen, Hampshire, IL (US); Jeffrey D. Anderson, Hampshire, IL (US); Christopher A. J. Iannello, Rolling Meadows, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/978,427

(22) PCT Filed: Jan. 6, 2012

(86) PCT No.: PCT/US2012/020458

§ 371 (c)(1),
(2), (4) Date: Jul. 5, 2013

(87) PCT Pub. No.: WO2012/094579

PCT Pub. Date: Jul. 12, 2012

(65) Prior Publication Data

US 2013/0276218 A1 Oct. 24, 2013

Related U.S. Application Data

(60) Provisional application No. 61/430,689, filed on Jan. 7, 2011.

(51) Int. Cl.

| | |
|---|---|
| ***A41D 13/00*** | (2006.01) |
| ***A41D 13/05*** | (2006.01) |
| ***F41H 1/02*** | (2006.01) |

(52) U.S. Cl.

CPC ..... *A41D 13/0518* (2013.01); *F41H 1/02* (2013.01); *A41D 13/0568* (2013.01)

USPC ..... 2/102; 2/456; 2/463

(58) Field of Classification Search

USPC ..... 2/466, 463, 455, 102, 2.5, 456

See application file for complete search history.

(56) References Cited

U.S. PATENT DOCUMENTS

| | | | | |
|---|---|---|---|---|
| 3,452,362 | A * | 7/1969 | Korolick et al. | 2/2.5 |
| 3,897,778 | A * | 8/1975 | Forbes-Robinson et al. | 128/875 |
| 4,545,773 | A * | 10/1985 | Evert | 441/114 |

(Continued)

FOREIGN PATENT DOCUMENTS

| | | | |
|---|---|---|---|
| DE | 102007058124 | A1 | 6/2009 |
| EP | 2261592 | A1 | 12/2010 |
| WO | 2009143464 | A2 | 11/2009 |
| WO | 2010102351 | A1 | 9/2010 |

OTHER PUBLICATIONS

International Search Report and Written Opinion corresponding to PCT/US2012/020458, dated May 8, 2012.

*Primary Examiner* — Richale Quinn

(74) *Attorney, Agent, or Firm* — Mark W. Croll; Paul F. Donovan

(57) ABSTRACT

A vest incorporating a pull element operatively connected to a plurality of tether lines extending along pathways to panel connection points at which front and rear panels of the vest are adjoined. When the pull element is extended away from the vest, the tether lines are placed into tension thereby causing the connection assemblies to be disengaged and the front and rear panels of the vest can fall away from one another. Locking elements within the connection assemblies return to their locking position upon release of the tension.

20 Claims, 9 Drawing Sheets

(56) References Cited

U.S. PATENT DOCUMENTS

| | | | | | |
|---|---|---|---|---|---|
| H000007 | H | * | 1/1986 | Martone | 2/2.5 |
| 5,060,314 | A | * | 10/1991 | Lewis | 2/2.5 |
| 5,966,747 | A | * | 10/1999 | Crupi et al. | 2/466 |
| 6,948,188 | B2 | * | 9/2005 | D'Annunzio | 2/102 |
| 7,047,570 | B2 | * | 5/2006 | Johnson | 2/102 |
| 7,987,523 | B2 | * | 8/2011 | Cole et al. | 2/102 |
| 8,201,271 | B2 | * | 6/2012 | Dennis | 2/102 |
| 8,403,818 | B1 | * | 3/2013 | Wilkinson et al. | 482/121 |
| 8,490,212 | B1 | * | 7/2013 | Asher et al. | 2/2.5 |
| 2004/0221361 | A1 | | 11/2004 | D'Annunzio et al. | |
| 2010/0313327 | A1 | | 12/2010 | Anscher | |
| 2011/0127307 | A1 | | 6/2011 | Carter et al. | |
| 2012/0000004 | A1 | | 1/2012 | Hellweg | |

* cited by examiner

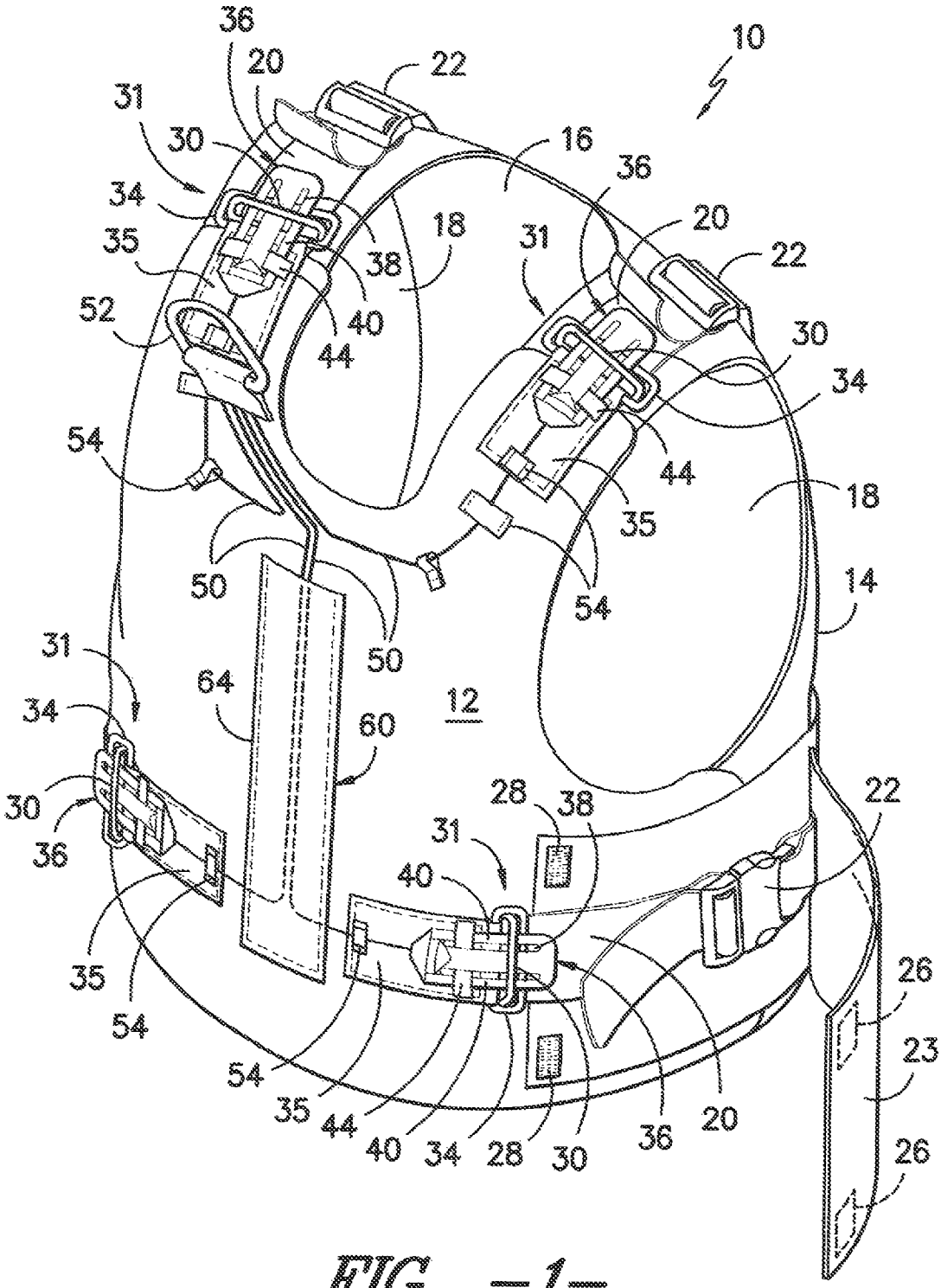
FIG. —1—

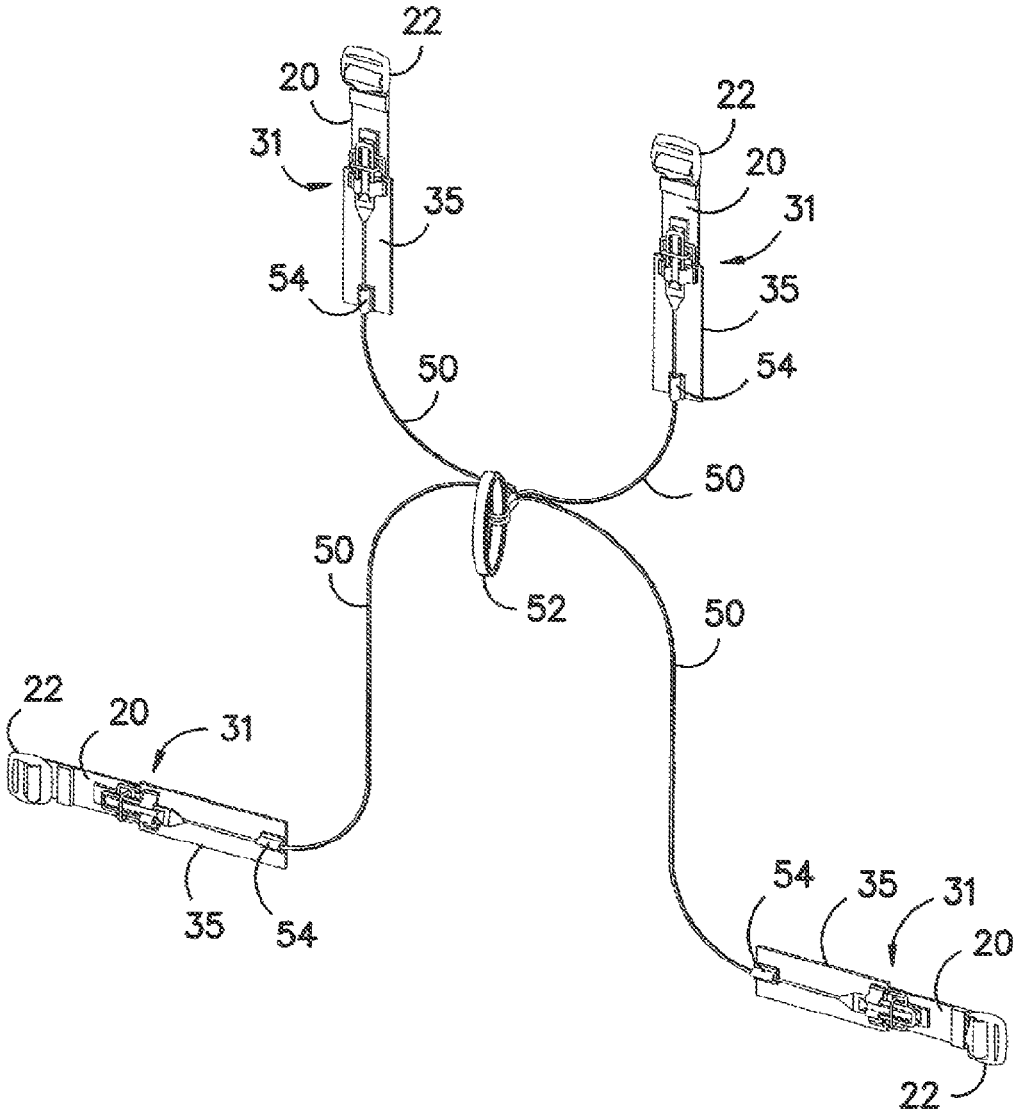
FIG. —2—

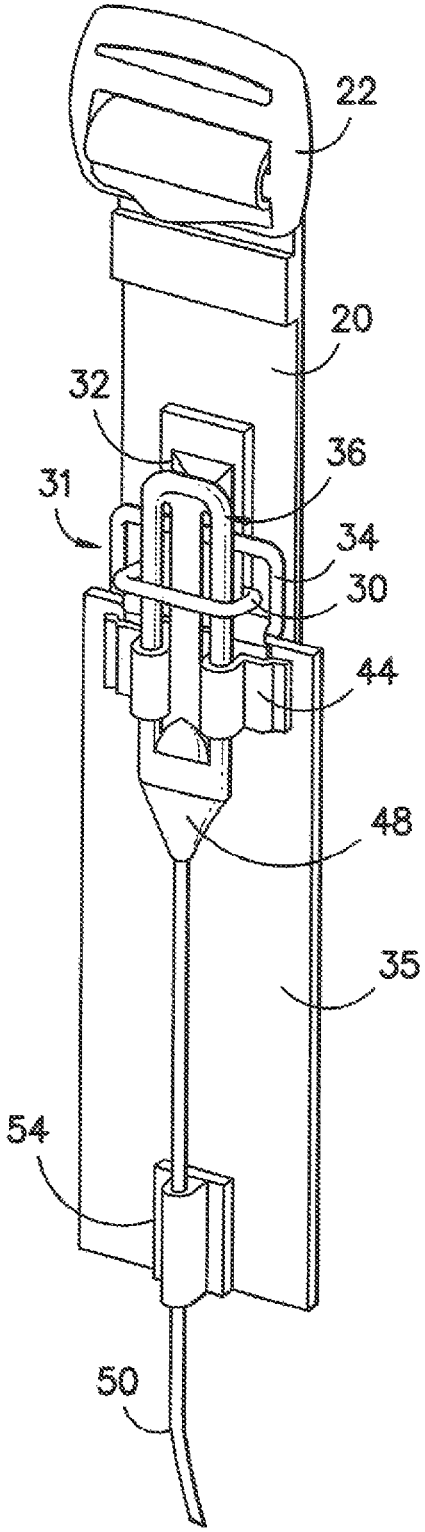
FIG. —3—

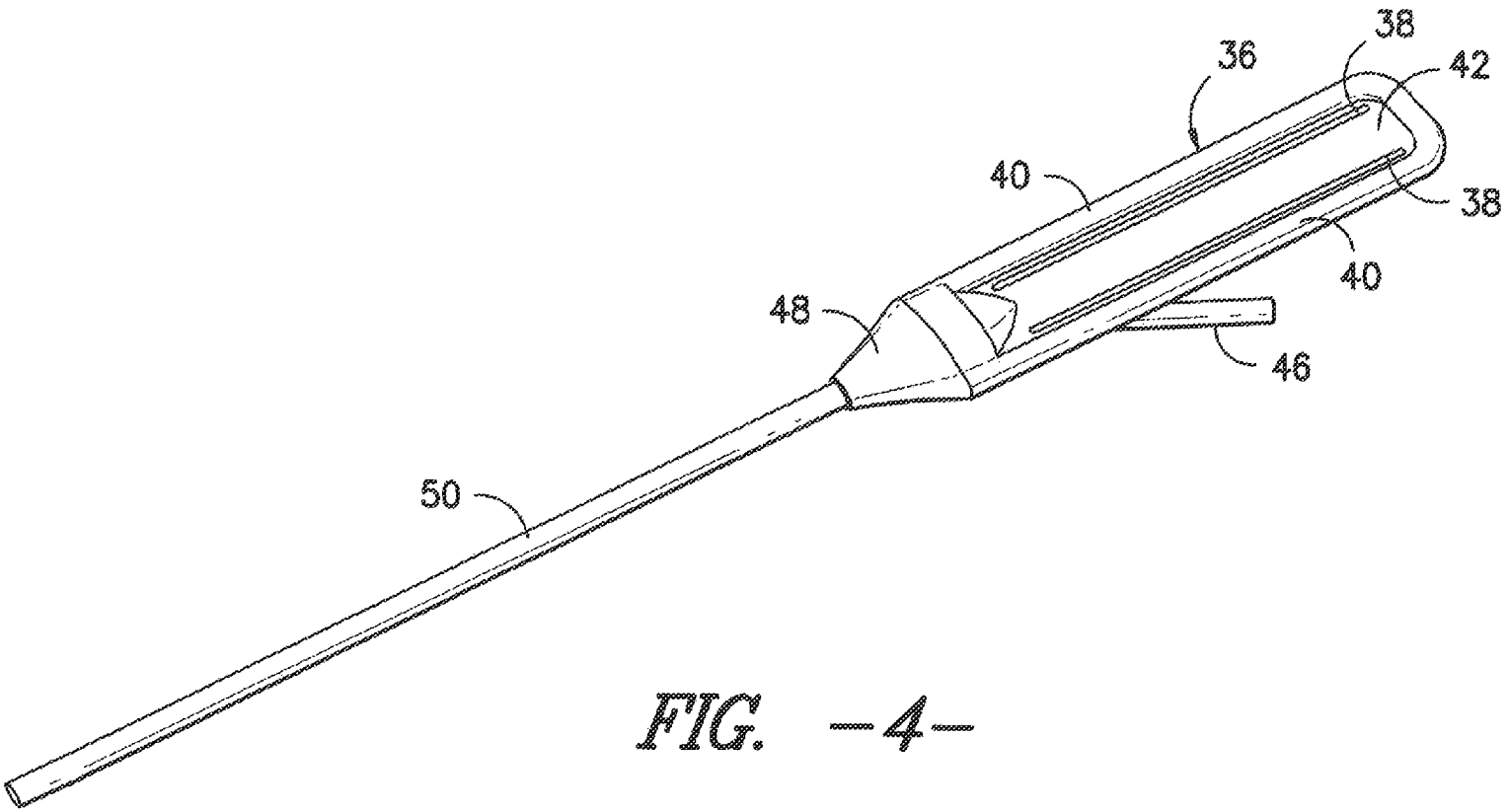
FIG. —4—

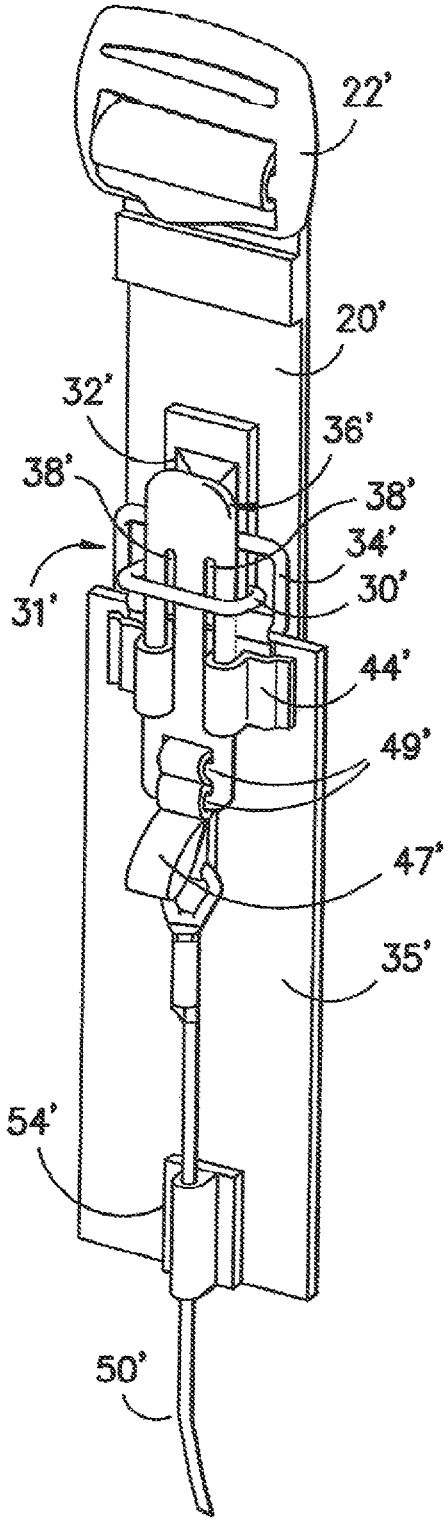
FIG. —5—

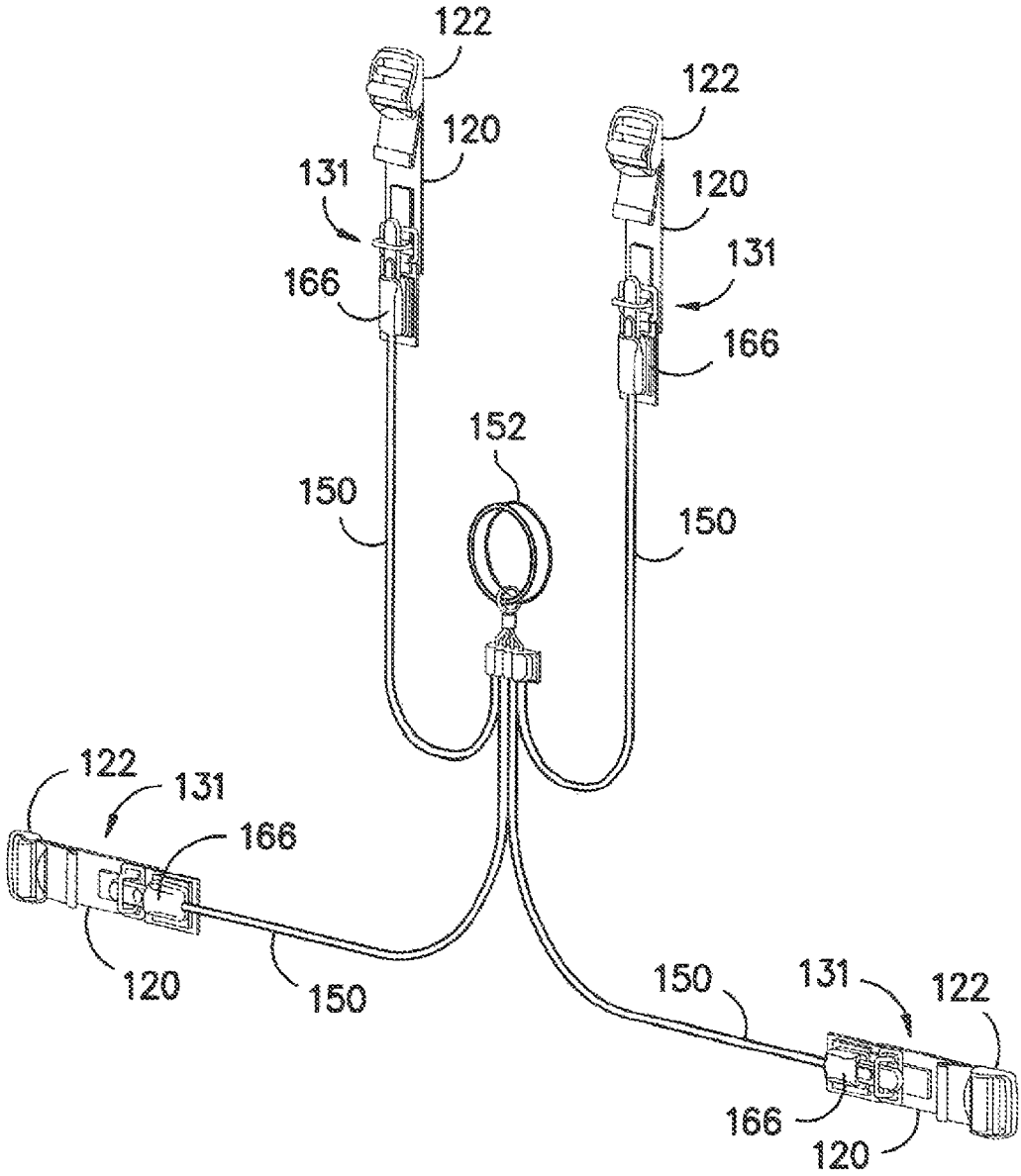
FIG. —6—

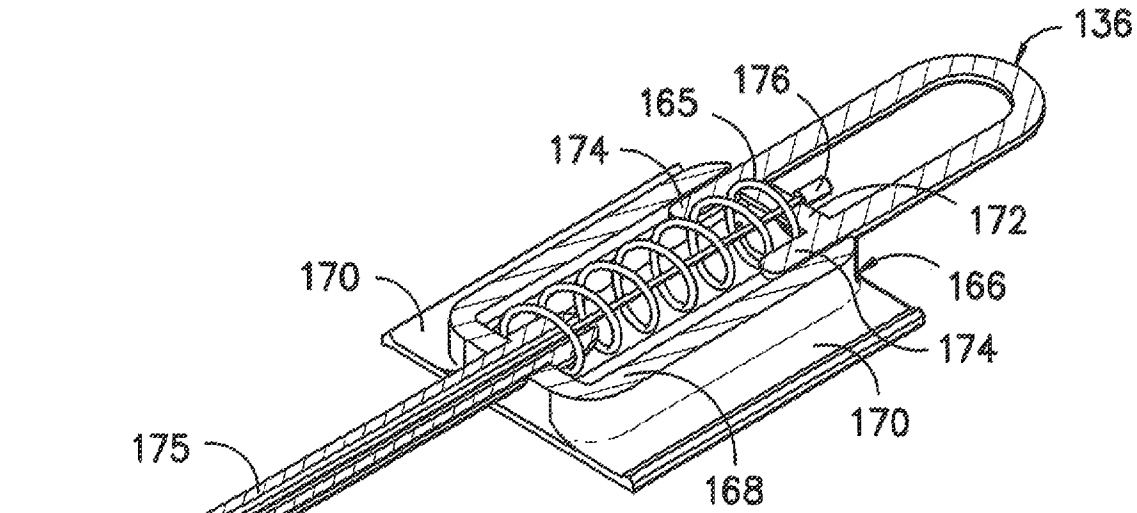
FIG. —7—
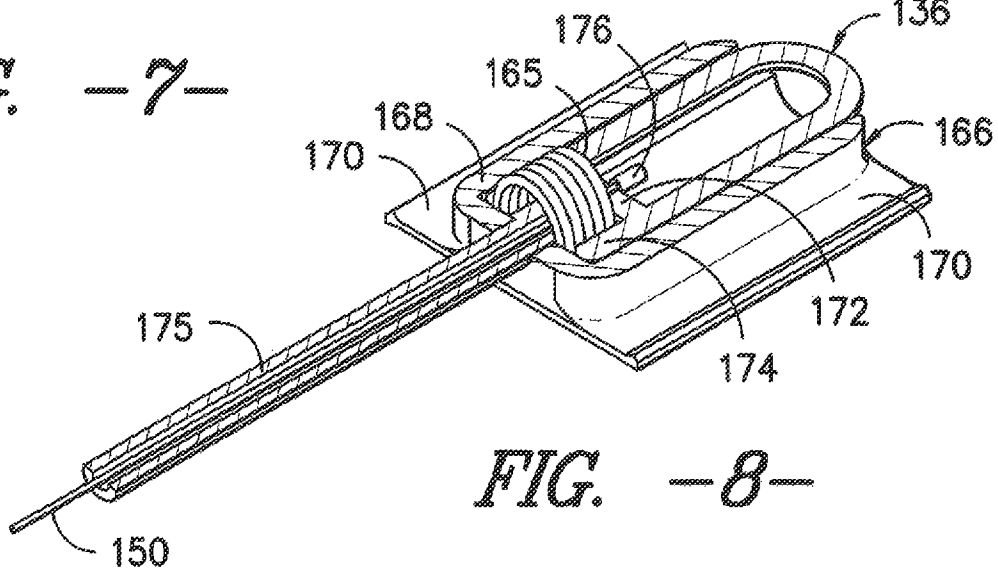
FIG. —8—

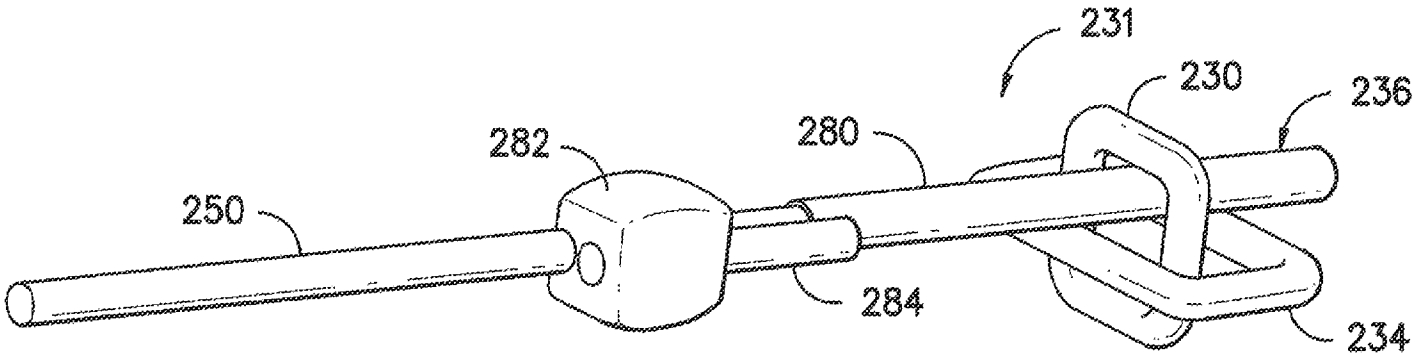
FIG. —9—
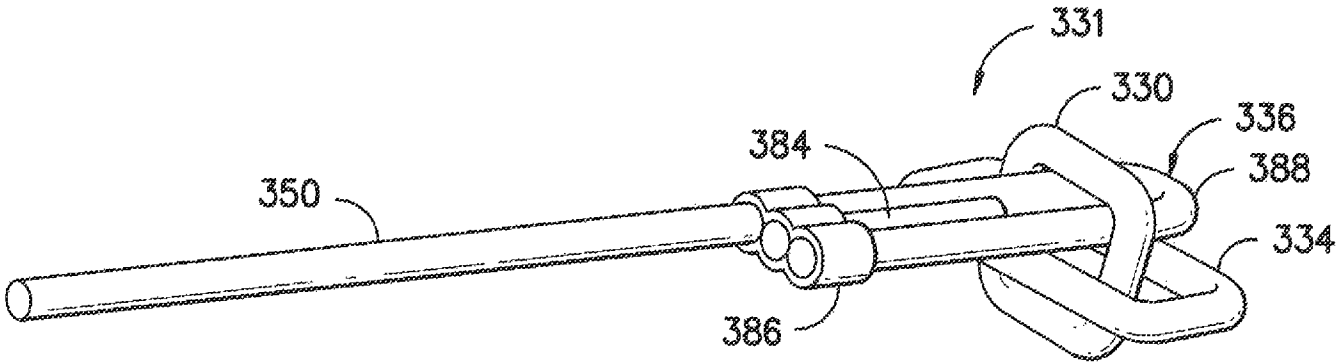
FIG. —10—

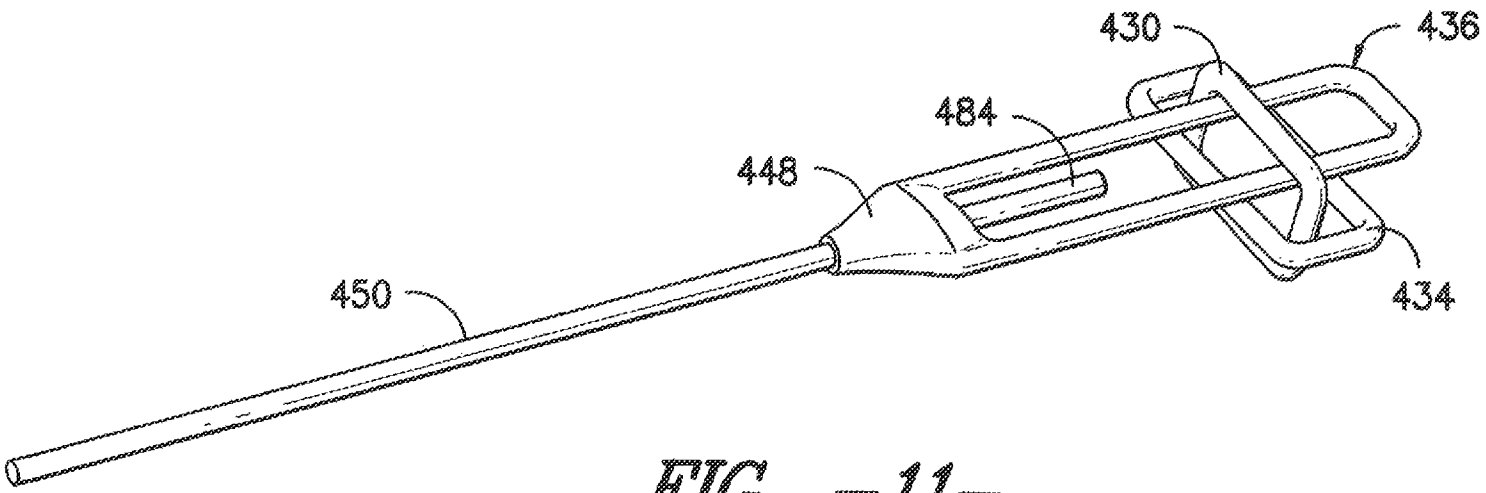
FIG. —11—

QUICK RELEASE CONNECTION ASSEMBLY

CROSS REFERENCE TO RELATED APPLICATION

This application is a National Phase of International Application Number PCT/US2012/020458, filed Jan. 6, 2012, and claims the benefit of U.S. Provisional Application 61/430,689 filed Jan. 7, 2011.

TECHNICAL FIELD

The present invention relates generally to a quick release connection unit adapted to operatively connect panels of fabric or other structures to one another in overlapping or edge-to-edge relationship. Multiple connection units may be connected via cables or the like to a master pull element to establish a multi-point connection system. Upon manual manipulation of the master pull element, the connection units disengage in a substantially simultaneous manner. Individual connection units may be disengaged by pulling localized release tabs.

BACKGROUND OF THE INVENTION

In many environments of use, it may be desirable for connections between panels of clothing or other structures to be activated and deactivated quickly. By way of example only, in the past it has been typical to use so called "Quick Release" clips at front or side openings of vests and other torso coverings. One prior clip arrangement incorporates a male member with a pair of laterally disposed legs that snap in locking relation within a relatively flat female body. In such a construction portions of the snap legs typically project through openings in the lateral sides of the female body in locking relation. The locking relation is disengaged by a user pressing inwardly against the lateral sides of the body to force the snap legs to the interior while applying a separating tensioning force. This permits the legs to be pulled outwardly from the body. While such prior structures provide excellent connective properties, each clip must be manipulated independently to remove the clothing article.

By way of example only, and not limitation, one potential environment of use for the quick release connection units of the present invention is in a vest for torso coverage used to provide protection to users such as police officers, military personnel or the like. Such vests are typically formed from aramid and para-aramid materials and serve a primary function of protecting against damage to core body organs as a result of projectile impact. A prior system for disengagement of panels in a protective vest is disclosed in U.S. Pat. No. 6,948,188 the teachings of which are hereby incorporated by reference as if fully set forth herein. However, alternative systems for quick release of a protective vest may be desirable.

The quick release connection units of the present invention may also be used in other environments of use if desired. Thus, while the invention will be described in reference to a protective vest, it is to be understood that that the quick release connection units may be used in virtually any other clothing article or other environment of use as may be desired.

SUMMARY OF THE INVENTION

The present invention provides advantages and alternatives over the prior art by providing a quick release system for adjoined panels of fabric or similar material. The system incorporates a pull element operatively connected to a plurality of tether lines extending along channel pathways to connection points at which panels are adjoined. When the pull element is extended the tether lines are placed into tension thereby disengaging latching assemblies which are normally biased to a latched position. Upon disengagement, the panels fall away from one another.

In accordance with one exemplary aspect, the present invention provides protective vest adapted for rapid removal from a wearer. The vest includes a front panel adapted to cover at least a portion of the wearer's chest and a rear panel adapted to cover at least a portion of the wearer's back. A plurality of connection assemblies operatively joins the front panel to the rear panel. At least a portion of the connection assemblies include a retractable locking element and further include a rotatable base ring in combination with a rotatable hasp ring structure matedly received at the interior of the base ring. The retractable locking element is normally disposed in a locked position in the absence of applied pulling tension and is adapted to slide from the locked position to an unlocked position upon application of pulling tension. In the locked position the retractable locking element projects through the hasp ring structure to block the hasp ring structure against removal from the base ring. A plurality of tether lines are operatively connected to a common pull element with at least one tether line operatively connecting each of the retractable locking elements to the common pull element, such that upon extension of the common pull element, the tether lines displace the retractable locking elements from the locked position to the unlocked position. At least one biasing element operatively engages a corresponding retractable locking element. The biasing element applies a recovery force to the retractable locking element upon displacement from the locked position such that the retractable locking element is moved back to the locked position upon removal of the applied pulling tension.

In accordance with another exemplary aspect, the present invention provides a protective vest adapted for rapid removal from a wearer. The vest includes a front panel adapted to cover at least a portion of the wearer's chest and a rear panel adapted to cover at least a portion of the wearer's back. A plurality of connection assemblies operatively joins the front panel to the rear panel, wherein at least a portion of the connection assemblies include a retractable locking element and further including a rotatable base ring in combination with a rotatable hasp ring structure matedly received at the interior of the base ring. The retractable locking element is normally disposed in a locked position in the absence of applied pulling tension and is adapted to slide from the locked position to an unlocked position upon application of pulling tension. In the locked position, the retractable locking element projects through the hasp ring structure to block the hasp ring structure against removal from the base ring. A plurality of tether lines are operatively connected to a common pull element with at least one tether line operatively connecting each of the retractable locking elements to the common pull element, such that upon extension of the common pull element, the tether lines displace the retractable locking elements from the locked position to the unlocked position. At least one biasing element comprising a spring operatively engages a corresponding retractable locking element. The spring applies a recovery force to the retractable locking element upon displacement from the locked position such that the retractable locking element is moved back to the locked position upon removal of the applied pulling tension.

A method of using a vest consistent with the present invention is also provided. Other objects, features and advantages will become apparent upon review of the accompanying drawings and review of the detailed description of corresponding embodiments.

BRIEF DESCRIPTION OF THE DRAWINGS

FIG. 1 is a schematic view illustrating a formed vest with front and rear panels attached by releasable connection assemblies operatively connected to tether lines extending from a common activating pull;

FIG. 2 is a schematic view illustrating an exemplary four-point connection system for connecting and releasing front and rear panels of a protective vest at waist and shoulder positions;

FIG. 3 is a schematic view of a first exemplary embodiment for a self-biasing quick release connection unit in accordance with the present invention;

FIG. 4 is a schematic view of an exemplary embodiment for a self-biasing male member for use in a quick release connection unit in accordance with the present invention;

FIG. 5 is a schematic view similar to FIG. 3 illustrating a second exemplary embodiment for a self-biasing quick release connection unit in accordance with the present invention with a substantially flat, stamped male member tongue;

FIG. 6 is a view similar to FIG. 2 illustrating another exemplary four-point connection system for connecting and releasing front and rear panels of a protective vest at waist and shoulder positions;

FIGS. 7 and 8 are cut-away schematic views illustrating operation of a self-biasing quick release connection unit for use in the system of FIG. 6;

FIG. 9 is a schematic view illustrating another self-biasing quick release connection unit;

FIG. 10 is a schematic view illustrating another self-biasing quick release connection unit; and FIG. 11 is a schematic view illustrating still another self-biasing quick release connection unit.

Before the exemplary embodiments of the invention are explained in detail, it is to be understood that the invention is in no way limited in its application or construction to the details and the arrangements of the components set forth in the following description or illustrated in the drawings. Rather, the invention is capable of other embodiments and being practiced or being carried out in various ways. Also, it is to be understood that the phraseology and terminology used herein are for purposes of description only and should not be regarded as limiting. The use herein of terms such as "including" and "comprising" and variations thereof is meant to encompass the items listed and equivalents thereof as well as additional items and equivalents thereof.

DETAILED DESCRIPTION OF THE PREFERRED EMBODIMENTS

Reference will now be made to the drawings, wherein to the extent possible, like elements are designated by like reference numerals in the various views. Referring to FIG. 1, a vest 10 is illustrated. By way of example only, and not limitation, the vest 10 may be a protective garment formed from materials such as woven aramid or para-aramid fibers adapted to resist penetration.

In the illustrated exemplary construction, the vest 10 is formed from a front panel 12 and a rear panel 14 which are oriented in opposing relation to one another to define a neck opening 16 and a pair of arm openings 18. As shown, the rear panel 14 may include an arrangement of connection straps 20 at the waist and shoulders. In the illustrated exemplary construction, each of the connection straps 20 is operatively connected to an adjustable buckle 22 to adjust the operative length. By way of example only, a connection strap 20 may be located on either side of the waist and at either shoulder of the vest 10. Of course, one or more of the adjustable buckles 22 may be eliminated if desired such that the corresponding connection strap 20 is of substantially fixed length.

As illustrated, a cover panel 23 (only one shown) may be disposed in flap-like relation on either side of the vest 10 to cover the connection straps 20 and the corresponding adjustable buckles 22 at the waist during use. By way of example only, the free end of the cover panel may include one or more panel attachment structures 26 such as one half of a hook and loop fabric for releasable attachment to complementary structures 28 such as the complementary half of a hook and loop fabric. Of course, other joining techniques may likewise be used if desired.

As best seen through joint reference to FIGS. 1, 2 and 3, in the exemplary construction, each of the connection straps 20 includes an operatively connected rotatable hasp ring 30 which forms a portion of an interlocking ring connection assembly 31 for releasable attachment of the front panel 12 to the rear panel 14 as will be described more fully hereinafter. By way of example only, and not limitation, the hasp ring 30 may be formed from a relatively rigid, smooth surface material such as metal, plastic or the like. Smooth surface steel may be particularly desirable. The hasp ring 30 may have a substantially rectangular or square geometry, although other configurations may be used if desired.

In practice, the hasp ring 30 may be held in place by a stitched loop connection 32 adjacent a free end of the corresponding connection strap 20. However, any other suitable connection which permits relatively free rotation of the hasp ring 30 may be used. As will be recognized, a stitched loop connection 32 may be formed by sewing a short length of fabric or other suitable material to the surface of the connection strap 20 and then threading a free end of the attached fabric through the hasp ring 30 and sewing the free end on top of the previously attached segment. Regardless of the attachment mechanism, the hasp ring 30 is preferably substantially rotatable relative to the connection strap 20 so as to be rotatable between a substantially flattened condition and a raised condition transverse to the connection strap 20. In this regard, rotation through about a 90 degree arc or more may be desirable. Rotation through about a 180 degree arc or more may be particularly desirable.

As best seen through joint reference to FIGS. 1 and 3, in the illustrated exemplary construction, the interlocking ring connection assembly 31 further includes a rotatable base ring 34 operatively secured to the front panel 12 at a position generally aligned with a corresponding connection strap 20. By way of example only, the base ring 34 may be held within a loop adjacent an end of a support panel 35 of fabric webbing or other suitable material secured by stitching or other suitable techniques to the front panel 12. However, direct connection to the front panel 12 also may be used if desired. By way of example only, and not limitation, the base ring 34 may be formed from a relatively rigid, smooth surface material such as metal, plastic or the like. Smooth surface steel may be particularly desirable. The base ring 34 may have a substantially rectangular or square geometry, although other configurations may be used if desired.

By way of example only, and not limitation, the base ring 34 projects away from the end of the support panel 35 and is preferably substantially rotatable through a wide arc so as to be rotatable between a generally flattened condition and a raised condition transverse to the underlying panel. Rotation through about a 90 degree arc or more may be desirable. Rotation through a full 180 degree arc or more may be particularly desirable in some environments of use.

As illustrated, in the exemplary construction, the hasp ring 30 which is operatively secured to the rear panel 14 has an effective outer diameter which is less than the inner diameter of the base ring 34. Thus, at least a portion of the hasp ring 30 may be inserted through the base ring 34 to form an interlocking connection between the front panel 12 and the rear panel 14. As will be appreciated, in the illustrated exemplary construction in which the hasp ring 30 is operatively secured in rotatable relation to the connection strap 20, the relative positions of the hasp ring 30 and the base ring 34 may be adjusted as desired to accommodate different size users.

As will be appreciated, with the hasp ring 30 inserted into the base ring 34, the resulting connection is not secure and will tend to fall apart. As best seen through joint reference to FIGS. 1, 3 and 4, in the exemplary construction a retractable male member 36 is disposed in floating relation to the support panel 35 at the front panel 12 for insertion into the portion of the hasp ring 30 projecting through the base ring 34. As shown, the male member 36 preferably has a generally low profile defining a rigid tongue with a slightly rounded forward edge to facilitate insertion into the hasp ring 30. The male member is preferably formed from a smooth plastic or other similar material. As will be appreciated, with the male member 36 in the inserted condition (FIG. 3), the hasp ring 30 is blocked against being withdrawn from the base ring 34. However, both the hasp ring 32 and the base ring 30 can nonetheless rotate to some degree to assume a low profile condition. When the male member is retracted, the hasp ring 30 is no longer blocked from withdrawal and the connection is released.

In the exemplary construction illustrated in FIGS. 1-4, the male member 36 incorporates a slotted track configuration including a pair of elongated parallel slots 38 running at least partially along the length dimension to define a pair of lateral guide rails 40 and an elongated interior rib 42. Of course, a larger number of slots with ribs between the slots also may be used.

In the illustrated construction, the male member 36 is held in slideable relation to the underlying support panel 35 or other underlying structure by a travel guide 44 of double yoke construction. The travel guide permits the male member to slide longitudinally while substantially maintaining lateral alignment. By way of example only, and not limitation, in one exemplary construction the travel guide 44 may be formed from a relatively narrow strip of fabric webbing or other suitable material which is woven through the slots 38 so as to pass over the lateral guiderails 40 and under the interior rib 42. Once the ends of the strip are sewn or otherwise attached to the underlying substrate, the male member 36 can slide longitudinally, but is otherwise secured against displacement.

As seen in FIG. 4, an elastomeric biasing element 46 such as a cord, strap, or other extendable structure of elastomeric character may extend away from the male member 36 for fixed attachment to the underlying connective webbing 35 or other substrate. By way of example only, the free end of the elastomeric biasing element 46 may be stitched to the underlying support panel 35 or other structure such that the elastomeric biasing element 46 urges the male member 36 towards the extended locking condition as shown in FIG. 3. Thus, if the male member 36 is caused to travel away from the illustrated locking condition by application of a displacement force, the elastomeric biasing element 46 will be placed into a state of enhanced tension in resistance to the movement and will spring back towards the initial condition upon removal of the displacement force.

In the exemplary construction illustrated in FIGS. 1-4, each of the male members 36 includes a proximal base portion 48 (FIG. 3) for attachment to an elongated tether line 50. Such connection may be by crimping, thermal bonding, or other suitable techniques. The elastomeric biasing element 46 is also secured to the proximal base by crimping or other suitable techniques. As best seen through joint reference to FIGS. 1 and 2, each of the elongated tether lines 50 extend along defined travel paths from the male members 36 to a common pull element 52 such as a ring structure or the like.

In operation, the pull element 52 may be grasped and pulled away from the vest 10, thereby extending the tether lines 50 and retracting the male members 36 out of the corresponding hasp rings 30. With the male members retracted from the hasp rings 30, the connection assemblies 31 will fall apart thereby releasing the connection between the front panel 12 and the rear panel 14 and causing the vest 10 to fall away from the user. As will be appreciated, all elements of the system including the tether lines 50, hasp rings 30, base rings 34, and male members 36 are operatively secured to either the front panel 12 or to the rear panel 14. Accordingly, when the common pull element 52 is extended, causing the front panel 12 and the rear panel 14 to fall away from the user, the individual components will remain attached to one or the other of the panels. Thus, components are not lost, and the vest 10 can be easily reassembled for subsequent use.

In practice, the tether lines 50 may run through tubing or sewn channels or may be threaded through spaced guide elements 54 operatively attached to the front panel by sewing or the like and positioned along the defined travel path to facilitate controlled travel. By way of example only, and not limitation, the tether lines 50 extending between the pull element 52 and the connection assemblies at the waist may be disposed within sewn channels at the interior of a surface patch structure 60. The surface patch structure 60 may be formed from a fabric or other suitable material and may be stitched along its perimeter by stitch lines 64 to form a pocket-like covering for the tether lines 50.

FIG. 5 illustrates a slightly different embodiment wherein elements corresponding to those described previously are designated by like reference numerals with a prime. As will be appreciated, the structure and operation of this embodiment are similar to that of FIG. 3 with the exception that the male member 36 defining a rigid tongue is substantially flat such as stamped metal or the like. In this embodiment, a connection strap 47 of fabric webbing or the like may be threaded around a pair of transverse bar segments 49 and through corresponding eyelets for connection to a loop at the end of the corresponding tether line 50. Of course, virtually any other connection arrangement to the flat male member may likewise be used.

In accordance with one exemplary practice, in use of the embodiment illustrated in FIG. 5, a piece of elastic webbing or other material with stretch and recovery character may be sewn between the connection strap 47 and the underlying support panel 35. Accordingly, when the corresponding tether line 50 is pulled back, the elastic webbing will be stretched and the male member 36 will be urged back to the initial outwardly projecting position illustrated. Of course, other recovery mechanisms may be used if desired.

FIGS. 6-8 illustrate another exemplary embodiment for a quick release system with self-returning male members wherein elements corresponding to those previously described are designated by like reference numerals within a 100 series. As shown, in the exemplary illustrated embodiment, the interlocking ring connection systems 131 function in substantially the same manner as previously described. However, rather than using a stretchable elastomeric member as the biasing element, the system of FIGS. 6-8 uses a mechanical biasing spring 165 such as a helical spring or the like of compressible character.

By way of example only, and not limitation, in the exemplary system of FIGS. 6-8, the retractable male member 136 is supported in sliding relation within a housing 166 which is open at one end facing towards the upstanding hasp ring projecting from the opposing connection strap 120. By way of example only, the housing 166 may be formed from a relatively light-gauge molded plastic such as nylon, polyester, polypropylene, or the like which may be sewn to an underlying fabric webbing or other support panel. In this regard, the housing 166 may include a main body 168 for supporting the biasing spring 165 and the retractable male member 136. A pair of integral flared legs 170 suitable for receipt of connective stitches (not shown) may extend laterally away from the main body 168 to hold the housing 166 in place on the underlying support substrate.

As illustrated, in the exemplary construction, the male member 136 has a generally "U" shaped configuration with an open interior and a crossbar 172 extending between lateral legs at a proximal position. A pair of proximal leg segments 174 project rearwardly on either side of the crossbar to define a space for containment of the biasing spring 165. A distal portion of a tether line 150 extends through a sleeve cover 175 and along the interior of the biasing spring 165 for secure attachment to the crossbar 172. By way of example only and not limitation, the distal portion of the tether line 150 may fit within a groove in the crossbar 172 with a large diameter head 176 blocking withdrawal when tension is applied. Of course, any other suitable attachment mechanism as may be desired may likewise be utilized.

As best seen through joint reference to FIGS. 7 and 8, upon the application of tension to the tether line 150 such as by extension of the pull element 152, the tether line moves rearwardly through the sleeve cover 175 and pulls the male member 136 from the extended position of FIG. 6 to the retracted position of FIG. 7. In the retracted condition, the biasing spring 165 is compressed from its normal extended condition and thus urges the male member forward to the extended condition. Thus, upon release of the tensioning force, the male member 136 will tend to spring back to the extended condition. The male member 136 also may be manipulated to the retracted position by application of a pushing force against the outwardly projecting nose. Thus, a user may manually manipulate the male member 136 to establish the desired locking arrangement during setup of the connection system. Of course, the biasing spring may also be arranged to be placed into tension upon retraction of the male member so as to urge the male member back towards the extended condition. Other biasing techniques, including the use of elastomeric members and the like as will be described further hereinafter also may be used.

It is also contemplated that any number of other configurations may be used for the retractable male member. By way of example only, in FIG. 9 an alternative interlocking ring attachment assembly 231 is illustrated. In this embodiment, elements corresponding to those previously described are designated by like reference numerals within a 200 series. As shown, in the illustrated exemplary construction the tether line 250 is surrounded at its distal end by a rigid outer sheath 280 of a relatively smooth surface polymer to define a male member 236. Under normal conditions (i.e. without the application of displacing tension) the portion of the tether line with the rigid outer sheath 280 projects through the hasp ring 230 to maintain an interlocking condition between the hasp ring 230 and the base ring 234. However, upon the application of a tensioning force to the tether line 250, the portion of the tether line with the rigid outer sheath 280 is retracted from the hasp ring 230 and the locking engagement is released.

As shown, in the embodiment of FIG. 9, the tether line 250 is clamped within a two-hole swage 282 such that the swage 282 moves with the tether line 250. One end of an extensible elastomeric member 284 such as an elastic cord or the like is also clamped within the swage 282. The free end of the extensible elastomeric member 284 may be anchored by sewing or other suitable techniques to an underlying support substrate (not shown) which is held at a substantially fixed position. As will be appreciated, upon the application of tension to the tether line 250 causing retraction of the portion of the tether line with the rigid outer sheath 280, the swage 282 also will be displaced. As displacement of the swage 282 takes place, the extensible elastomeric member 284 is stretched. This stretching provides a recovery force which urges the swage and the operatively connected male member 236 back to the initial position. Thus, upon release of the tensioning force to the tether line 250, the male member 236 will tend to spring back to the initial position.

In FIG. 10 an alternative interlocking ring attachment assembly 331 is illustrated. In this embodiment, elements corresponding to those previously described are designated by like reference numerals within a 300 series. As shown, in the illustrated exemplary construction the tether line 350 is clamped within a three-hole swage 386 to form a distal loop 388. This clamped distal loop 388 thus defines a retractable male member 336. Under normal conditions (i.e. without the application of displacing tension) the distal loop 388 projects through the hasp ring 330 to maintain an interlocking condition between the hasp ring 330 and the base ring 334. However, upon the application of a tensioning force to the tether line 250, the distal loop is retracted from the hasp ring 330 and the locking engagement is released.

As shown, in the embodiment of FIG. 10, the tether line 350 is clamped within the three-hole swage 386 such that the swage moves with the tether line 350. One end of an extensible elastomeric member 384 such as an elastic cord or the like is also clamped within the three-hole swage 386. The free end of the extensible elastomeric member 384 may be anchored by sewing or other suitable techniques to an underlying support substrate (not shown) which is held at a substantially fixed position. As will be appreciated, upon the application of tension to the tether line 350 causing retraction of the distal loop 388, the swage 386 also will be displaced. As displacement of the swage 386 takes place, the extensible elastomeric member 384 is stretched. This stretching provides a recovery force which urges the swage 386 and the operatively connected distal loop 388 back to the initial position. Thus, upon release of the tensioning force to the tether line, the distal loop 388 will tend to spring back to the initial locking position.

In FIG. 11 an alternative interlocking ring attachment assembly 431 is illustrated. In this embodiment, elements corresponding to those previously described are designated by like reference numerals within a 400 series. As shown, in the illustrated exemplary construction the tether line 450 is clamped to the base of a retractable male member 436 having an elongated rectangular configuration with an open interior. Under normal conditions (i.e. without the application of displacing tension) the male member 436 projects through the hasp ring 430 to maintain an interlocking condition between the hasp ring and the base ring 434. However, upon the application of a tensioning force to the tether line 450, the male member is retracted from the hasp ring 430 and the locking engagement is released.

As shown, in the embodiment of FIG. 11, one end of an extensible elastomeric member 484 such as an elastic cord or the like is also clamped within the base of the male member 436. The free end of the extensible elastomeric member 484 may be anchored by sewing or other suitable techniques to an underlying support substrate (not shown) which is held at a substantially fixed position. Upon the application of tension to the tether line 450 causing retraction of the male member, the extensible elastomeric member 384 is stretched. This stretching provides a recovery force which urges the male member 436 back to the initial position. Thus, upon release of the tensioning force to the tether line, the male member 436 will tend to spring back to the initial locking position.

The present invention provides a number of benefits. Specifically, multiple quick release members may be operatively connected such that a single pull action may be used to provide simultaneous release while localized pull tabs may be used to release individual connections independently from one another. Following release, the elements return to their normal position for reassembly.

Of course, variations and modifications of the foregoing are within the scope of the present invention. Thus, it is to be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments and equivalents to the extent permitted by the prior art.

What is claimed is:

1. A protective vest adapted for rapid removal from a wearer, the vest comprising:

a front panel adapted to cover at least a portion of the wearer's chest;

a rear panel adapted to cover at least a portion of the wearer's back;

a plurality of connection assemblies operatively joining the front panel to the rear panel wherein at least a portion of the connection assemblies each include a retractable locking element and further including a rotatable base ring in combination with a rotatable hasp ring structure matedly received at the interior of the base ring, the retractable locking element being normally disposed in a locked position in the absence of applied pulling tension and adapted to slide from the locked position to an unlocked position upon application of pulling tension, wherein in the locked position the retractable locking element projects through the hasp ring structure to block the hasp ring structure against removal from the base ring;

a plurality of tether lines operatively connected to a common pull element with at least one tether line operatively connecting each of the retractable locking elements to the common pull element, such that upon extension of the common pull element, the tether lines displace the retractable locking elements from the locked position to the unlocked position; and at least one biasing element operatively engaging a corresponding retractable locking element, the biasing element applying a recovery force to the retractable locking element upon displacement from the locked position such that the retractable locking element is moved back to the locked position upon removal of the applied pulling tension.

2. The protective vest as recited in claim 1, wherein at least one of the front panel and the rear panel is formed from an aramid or para-aramid fabric.

3. The protective vest as recited in claim 1, wherein the rotatable hasp ring is secured to a connection strap on the rear panel and the rotatable base ring is operatively secured to a support substrate on the front panel.

4. The protective vest as recited in claim 3, wherein the support substrate is a fabric segment sewn to the front panel.

5. The protective vest as recited in claim 4, wherein the retractable locking element comprises a rigid tongue supported in sliding relation on the support substrate.

6. The protective vest as recited in claim 5, wherein the retractable locking element is held to the support substrate by a travel guide sewn to the support substrate, the travel guide including containment loops disposed in raised relation to the support substrate.

7. The protective vest as recited in claim 6, wherein the retractable locking element includes a plurality of elongated slots extending in the length dimension, and wherein the travel guide comprises a webbing segment woven through the slots in the width dimension to define a sine wave construction.

8. The protective vest as recited in claim 1, wherein the retractable locking element comprises a rigid sheath disposed about a distal end of a tether line.

9. The protective vest as recited in claim 8, wherein the tether line and is secured within a displaceable swage, and wherein an extensible elastomeric member operatively connects the swage to a fixed position, such that displacement of the locking element causes stretching of the extensible elastomeric member.

10. The protective vest as recited in claim 1, wherein the retractable locking element comprises a loop disposed at a distal end of a tether line.

11. The protective vest as recited in claim 10, wherein the loop extends away from a displaceable swage secured to the tether line, and wherein an extensible elastomeric member operatively connects the swage to a fixed position, such that displacement of the locking element causes stretching of the extensible elastomeric member.

12. The protective vest as recited in claim 1, wherein the retractable locking element comprises a rigid tongue having a base and a perimeter frame surrounding an open interior.

13. The protective vest as recited in claim 12, wherein an extensible elastomeric member operatively connects the base to a fixed position, such that displacement of the locking element causes stretching of the extensible elastomeric member.

14. A protective vest adapted for rapid removal from a wearer, the vest comprising:

a front panel adapted to cover at least a portion of the wearer's chest;

a rear panel adapted to cover at least a portion of the wearer's back;

a plurality of connection assemblies operatively joining the front panel to the rear panel wherein at least a portion of the connection assemblies each include a retractable locking element and further including a rotatable base ring in combination with a rotatable hasp ring structure matedly received at the interior of the base ring, the retractable locking element being normally disposed in a locked position in the absence of applied pulling tension and adapted to slide from the locked position to an unlocked position upon application of pulling tension, wherein in the locked position the retractable locking element projects through the hasp ring structure to block the hasp ring structure against removal from the base ring;

a plurality of tether lines operatively connected to a common pull element with at least one tether line operatively connecting each of the retractable locking elements to the common pull element, such that upon extension of the common pull element, the tether lines displace the retractable locking elements from the locked position to the unlocked position; and at least one biasing element comprising a spring operatively engaging a corresponding retractable locking element, wherein the spring applies a recovery force to the retractable locking element upon displacement from the locked position such that the retractable locking element is moved back to the locked position upon removal of the applied pulling tension.

15. The protective vest as recited in claim 1, wherein the spring and the retractable locking element are supported within a common polymeric housing operatively secured to an underlying support substrate.

16. The protective vest as recited in claim 15, wherein the spring is a compressible spring disposed between the retractable locking element and a portion of the housing, such that upon displacement of the retractable locking element from the locked position, the spring is placed into compression.

17. The protective vest as recited in claim 16, wherein the spring is a helical spring.

18. The protective vest as recited in claim 17, wherein the retractable locking element comprises a rigid tongue having a perimeter frame surrounding an open interior.

19. The protective vest as recited in claim 18, wherein the perimeter frame has a generally "U" shaped configuration, wherein a crossbar extends between lateral sides of the perimeter frame, and wherein the spring is disposed between the crossbar and a rear wall of the housing, the perimeter frame including a pair of leg segments projecting away from the crossbar towards the rear wall and extending laterally on either side of the spring.

20. A method of rapidly removing a protective vest from a wearer, the method comprising:

providing a plurality of connection assemblies operatively joining the front panel to the rear panel wherein at least a portion of the connection assemblies each include a retractable locking element and further including a rotatable base ring in combination with a rotatable hasp ring structure matedly received at the interior of the base ring, the retractable locking element being normally disposed in a locked position in the absence of applied pulling tension and adapted to slide from the locked position to an unlocked position upon application of pulling tension, wherein in the locked position the retractable locking element projects through the hasp ring structure to block the hasp ring structure against removal from the base ring;

providing a plurality of tether lines operatively connected to a common pull element with at least one tether line operatively connecting each of the retractable locking elements to the common pull element, such that upon extension of the common pull element, the tether lines displace the retractable locking elements from the locked position to the unlocked position;

providing at least one biasing element operatively engaging a corresponding retractable locking element, the biasing element applying a recovery force to the retractable locking element upon displacement from the locked position such that the retractable locking element is moved back to the locked position upon removal of the applied pulling tension; and extending the common pull element such that the tether lines displace the retractable locking elements and disengage each of the connection assemblies substantially simultaneously.

* * * * *